United States Patent [19]

Sherwin

[11] 4,196,921

[45] Apr. 8, 1980

[54] CROSS-COUNTRY SKI BOOT RESTRAINING APPARATUS

[76] Inventor: William C. Sherwin, 1538 S. 9th East, Salt Lake City, Utah 84105

[21] Appl. No.: 933,547

[22] Filed: Aug. 14, 1978

Related U.S. Application Data

[63] Continuation-in-part of Ser. No. 731,558, Oct. 12, 1976, Pat. No. 4,113,275.

[51] Int. Cl.[2] ..... A63C 9/18

[52] U.S. Cl. ..... 280/615

[58] Field of Search ..... 280/611, 614, 615, 625, 280/627, 635, 628

[56] References Cited

U.S. PATENT DOCUMENTS

| | | | |
|---|---|---|---|
| 2,468,879 | 5/1949 | Hvam | 280/627 |
| 3,775,866 | 12/1973 | Marker | 280/615 X |
| 4,008,908 | 2/1977 | Pierson | 280/636 |

FOREIGN PATENT DOCUMENTS

| | | | |
|---|---|---|---|
| 292861 | 7/1916 | Austria | 280/618 |
| 173649 | 6/1952 | Austria | 280/618 |

*Primary Examiner*—Richard A. Bertsch
*Assistant Examiner*—Michael Mar
*Attorney, Agent, or Firm*—A. Ray Osburn

[57] ABSTRACT

An improvement for cross-country ski bindings comprising apparatus for preventing or limiting lateral motion of a cross-country ski boot with respect to the ski when the boot is lowered into close proximity with the upper surface with the ski. The apparatus may comprise two pivotal vertically upstanding members between which the ski boot fits, the upstanding members being biased apart from each other so that the boot enters freely therebetween, the weight of the skier then, applied through the sole of the boot, causing the vertical members to move closer together to grip the boot in its general central, instep, portion. Thus the boot is firmly held in a central location on the ski. When, during use of the ski, it is desired to raise the boot, the vertical members are biased outwardly to release the boot. The apparatus may also comprise a plate upon which the heel of the boot rests when the boot is in its downward position upon the upper surface of the ski, the plate being selectively positionable with respect to its longitudinal position upon the ski, so that the apparatus will accomodate ski boots of varying sizes. The apparatus, therefore provides for the use of cross-country skis with improved efficiency and facility, especially for the novice or beginning skier. Further, the ski incorporating the present invention may be used under a variety of snow and grade conditions without manual adjustment or manual attachment and detachment of the boot to the ski.

7 Claims, 6 Drawing Figures

CROSS-COUNTRY SKI BOOT RESTRAINING APPARATUS

This is a continuation-in-part to application Serial No. 731,558, SKI BOOT HEEL RESTRAINING APPARATUS, filed Oct. 12, 1976, now Pat. No. 4,113,275 William Claude Sherwin, Inventor.

BACKGROUND

1. Field of Invention

The present invention relates broadly to the binding of the ski boots to skis and more particularly to the binding of ski boots to cross-country skis. With still more particularity, the present invention relates to restraint of horizontal rotation of a cross-country ski boot with respect to a cross-country ski.

2. Prior Art

With downhill skis, it is desirable that the ski boot be firmly and substantially immoveably attached to the ski boot, so that the skier may substantially control the orientation of the skis as he travels downhill under the influence of gravity. The bindings securing the boot to the ski for downhill skiing should release in the event of dangerous levels of stress applied to the ankle or legs of the skier, and the art of such ski bindings is well advanced so that the danger of injury to the skier is reduced in the event of spills and the like. The use of cross-country and mountaineer skis contrasts with the use of downhill skis, in that the boot, except for its toe, must be free to move vertically with respect to the ski, so that the skier may stride forward to propel the skis and the skier along the surface of the snow. Such forward striding requires that the boot be free to rotate vertically with respect to the ski. Cross-country ski boots and the like are therefore typically relatively flexible in contrast to the substantially rigid downhill ski boots, and are fastened firmly to the ski only at their toes. In the course of propelling himself along the snow upon the skis, the cross country skier must alternately place substantially his entire weight upon the approximate center of the ski, the bottom of which is adapted to provide the necessary friction. In this aspect of the use of cross country skis, it is extremely desirable that the foot be aligned generally axially with the ski.

Heretofore, no effective apparatus has been provided to effectively prevent the tendency toward rotation of the ski boot laterally in respect to the ski. This has resulted in considerable difficulty for the skier to keep his foot aligned over the ski to provide the necessary traction for forward motion and to easily keep the skis aligned in a parallel forward orientation to facilitate his travel along the surface of the snow. With the present bindings, further difficulty arises when the cross country skier coasts downhill in that the skier can exercise less than desirable control over the skis to control either his downhill velocity or his direction of downhill motion. To partially obviate the aforesaid problems some bindings for cross country ski boots have provided for the manual selection between substantially full restraint of the boot in both the lateral and vertical directions and substantially total lack of such restraint. With this approach, the skier must frequently successively manually release and secure his ski boots to the skis, resulting in much difficulty, and often exasperation, on the part of the skier. Further, such an approach is inherently dangerous, since the skier may inadvertently leave his boot unattached when it should be attached to provide needed control, and vice versa.

Another approach to the problem of providing free vertical rotation of the boot while restraining its lateral movement has involved the use of elastic or spring tensioned cables engaging the heel to the ski. This approach, however, does not provide for completely unimpeded vertical movement of the boot, nor does it substantially prevent the undesired lateral movement.

BRIEF SUMMARY AND OBJECTS OF THE INVENTION

With the foregoing in mind, the present invention prevents or substantially alleviates the aforesaid disadvantages of present cross country and mountaineer ski bindings by providing apparatus communicating the ski with the cross country ski boot, whereby lateral rotation of the boot is substantially prevented when the boot is in close proximity to the upper surface of the ski, while unimpeded vertical rotation of the boot is still permitted. Further, the boot is guided by the apparatus into proper orientation with respect to the ski when the boot is lowered into the apparatus. In accordance with the invention, the ski boot is affirmatively gripped and secured into a central position upon the ski when the boot is lowered into the apparatus, while the desired unimpeded vertical removal of the boot upwardly from the ski is retained.

Accordingly, it is a primary object of the present invention to provide a novel and improved binding for cross country skis.

A paramount object of the invention is to provide an improved restraint for a cross country ski boot whereby lateral roation of the boot with respect to the ski is substantially prevented.

A further object of the invention is to provide lateral restraint of a cross country ski boot while permitting complete unimpeded vertical rotation of the boot with respect to the ski.

Another object of the invention is to provide for the positive affirmative gripping of the boot into the desired central location in respect to the ski.

Another significant object of the invention is to provide an improved binding for cross country skis whereby the use of the skis is facilitated for both accomplished and beginning skiers.

Another object of the invention is to privide an improved yet simple and economical improvement to cross country ski bindings.

A still further object of the invention is to provide an improvement in cross crountry and mountaineer skis which may be readily used in cooperation with available conventional bindings for the toes of cross country and mountaineer ski boots.

A further and significant object of the invention is to provide improved control of cross country and mountaineer skis used in the downhill direction.

Another significant object of the invention is to provide an improved binding for a cross country ski boot whereby the skier can provide for traveling uphill, level, or downhill upon the snow without making manual adjustments or attachments of the ski to his boot.

These and further objects and advantages of the present invention will be apparent from the following detailed description of embodiments of the invention made with reference to the accompanying drawings:

DETAILED DESCRIPTION OF ILLUSTRATED EMBODIMENTS

Figure 1:
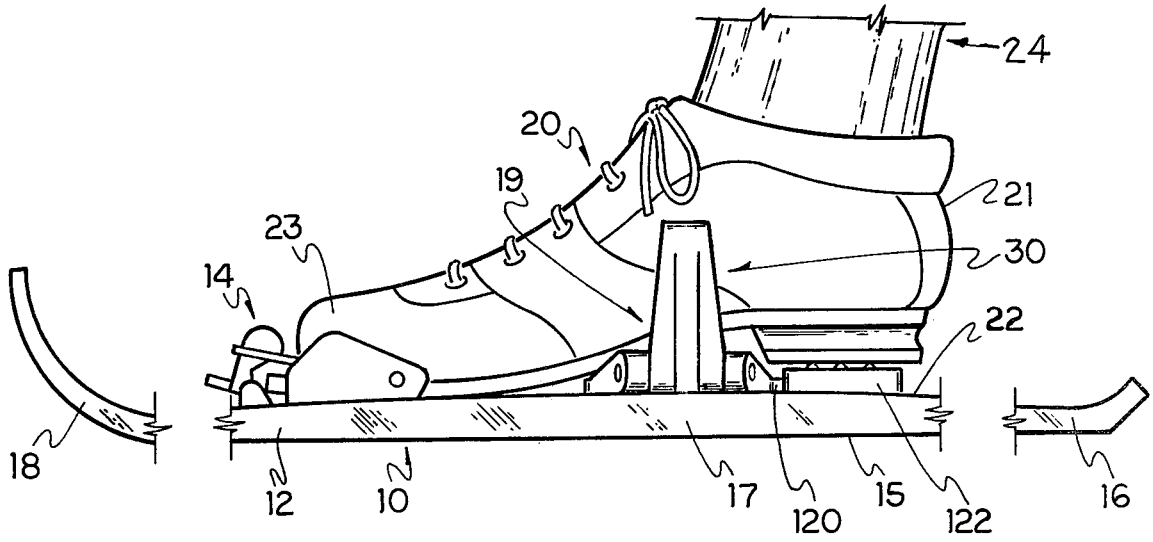
FIG. 1 is a partial representative of a cross-country ski showing a boot worn by the user disposed thereon downwardly into one embodiment of the heel restrainer.
Figure 2:
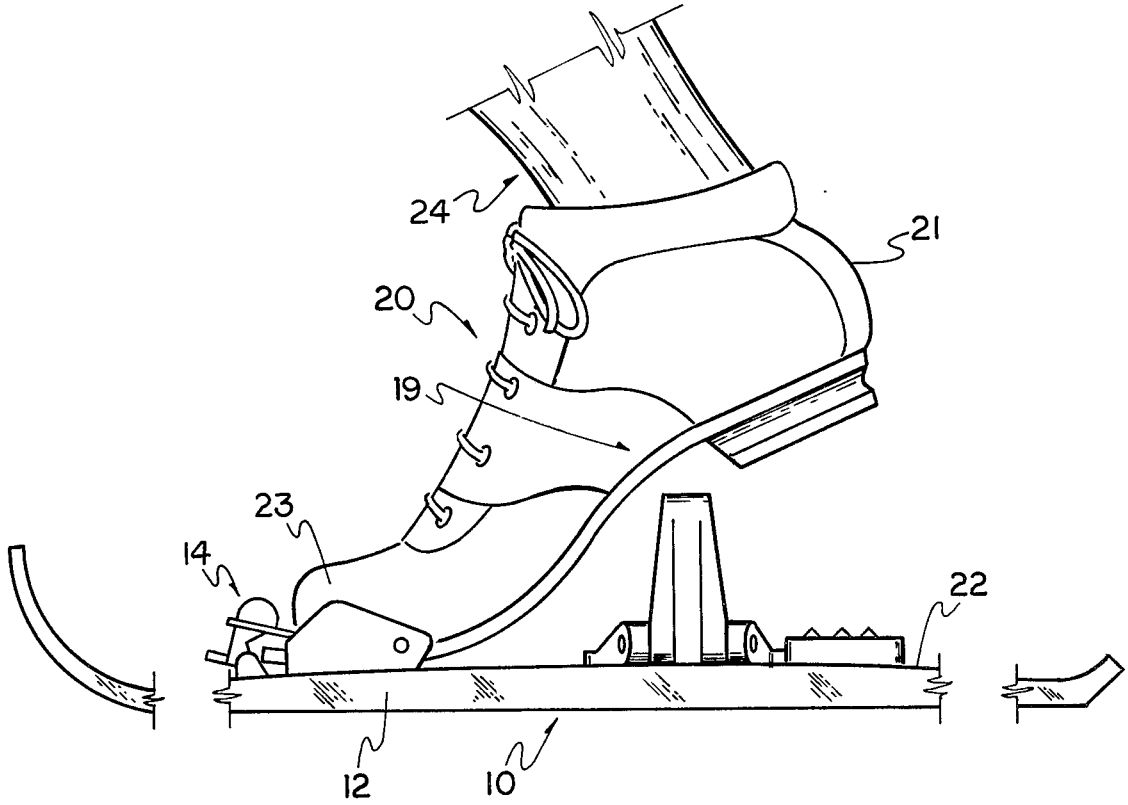
FIG. 2 is a partial representation of the ski of FIG. 1 with the boot raised partially from the restrainer.

Reference is now made to the FIGS. wherein like parts are designated by like numerals throughout. FIGS. 1 and 2 in particular illustrate a ski assembly, generally designated 10, comprising an elongated ski 12 having a front curved portion 18, a rear essentially straight portion 16 and a central portion 17. The ski has a lowermost snow engaging surface 15 and an upper surface 22. A toe binding 14 is provided securing the toe 23 of a boot 20 to the ski 12. The binding 14 may be selected from among numerous available toe bindings widely used for cross-country or mountaineering skiing. The binding 14 allows the operator 24 to raise the boot 20 away from the upper surface 22 during use of the ski 12, as seen in FIG. 2. The boot 20 may be somewhat flexible so as to further promote such necessary vertical movement.

Typical toe bindings 14, while firmly securing toe 23 of boot 20, nevertheless permit substantial horizontal rotation of the boot 20. This results in frequent displacement of rearward portions of the boot 20 laterally from the center of the ski 12 as it is used. Further, the boot 20 is typically somewhat flexible, which adds to the problem of such lateral movement. Such lateral movement reduces the control of the ski assembly 10 by the skier, since he can apply less control by means of the toe bindings than he could were the rearward portions of the boot further restrained against horizontal rotation from the center of the ski. Such restraint is most advantageously applied at the central or instep portion of the boot 20, as is described in detail hereinafter.

A boot restrainer, seen in FIG. 1 and generally designated 30, and which is the subject of this invention, is secured to the upper surface 22 of the ski 12. The restrainer 30 of FIG. 1 is one of two embodiments herein, both of which substantially prevent lateral motion of the boot 20 when lowered so as to be in close proximity with the upper surface 22 of the ski 12.

The restrainer 30, in both illustrated embodiments, permits free vertical movement of the boot 20 in respect to the ski 12, as can be seen in FIG. 2. The restricted lateral movement of the boot 20, along with the unrestricted vertical movement thereof, greatly facilitates the use of the ski assembly 10 for moving the operation 24 along the snow in the level, uphill, or downhill directions.

The presently preferred embodiments of the boot restrainer 30 are now each separately described with reference to the Figures.

Figure 3:
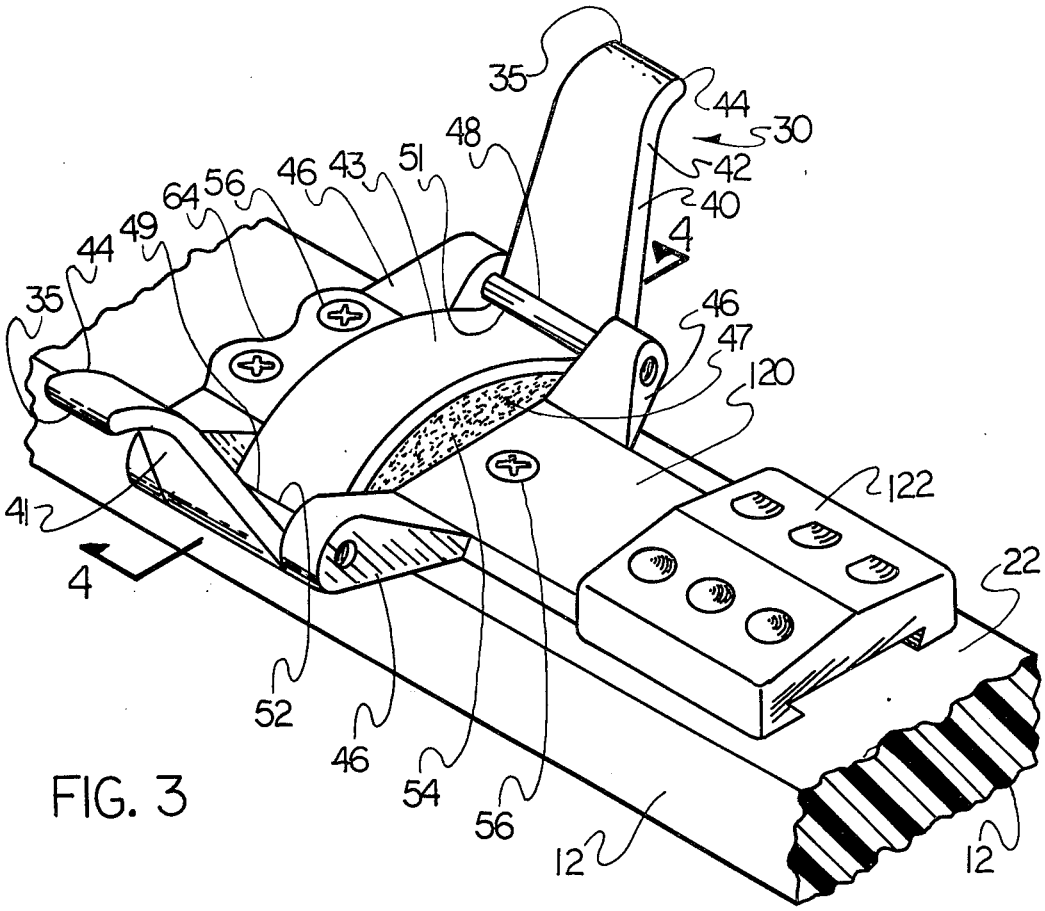
FIG. 3 is an enlarged perspective representation of a first embodiment of the restrainer.

One presently preferred embodiment of the boot restrainer 30 is seen in FIG. 3. The restrainer embodiment 30 seen in FIG. 3 comprises a continuous member 40 having two spaced apart, generally vertically extending members 41 and 42 contiguous with a generally horizontal but upwardly curved lower center portion 43. The center portion 43 is of elastic spring-like material. The spaced apart members 41 and 42 may be angled outwardly from the center of the ski 12 so that the space therebetween is tapering.

The base 64 carries an extension 120 upon which is mounted a heel plate 122 of appropriate thickness to accept the bottom of the heel 21 when the boot is in its lowermost position. The structure and function of the extension 120 and the heel plate 122 are more fully described hereinafter in connection with a second preferred embodiment of the invention shown in FIGS. 5 and 6, said structure and function being in all respects similar to the two illustrated embodiments.

The member 40 is configurated to comprise channel or groove-like portions 51 and 52 oriented longitudinally to the ski 12 and accepting pins 48 and 49 therein. The pins 48 and 49 are each restrained by clamping portions 46 of the base plate 64 secured to the upper surface 22 of the ski 12 by screws 56 installed in bores, not shown, extending through the plate 64 into bores, not shown, into the ski 12.

Figure 4:
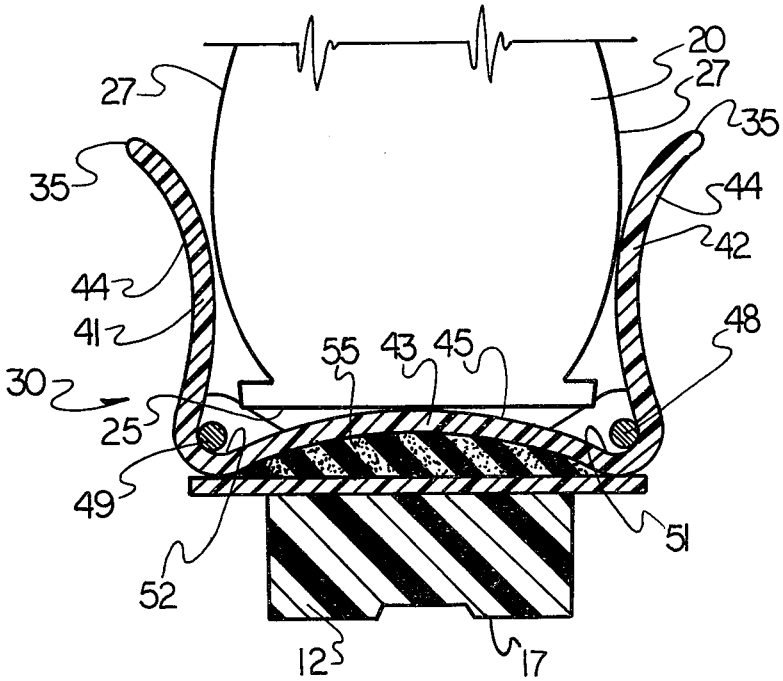
FIG. 4 is a cross-sectional representation of the restrainer of FIG. 3 taken along the line 4—4 of FIG. 3, showing also a ski boot disposed therein and being gripped by the restrainer.

As best seen in FIG. 4, the bottom 25 of the boot 20 engages the upper surfaces 45 of the center portion 43, causing the portion 43 to straighten and be deflected generally downwardly. As the portion 43 is thus forced downward, the groove-like portions 52 and 51 communicate essentially pivotally with the pins 48 and 49 so that the upwardly extending portions 41 and 42 are rotated toward the center of the ski 12 to grip the sides 27 of the boot 20. In this manner, the operator 24 of the ski 12 is able to exercise increased control over the ski during its use for climbing, propelling himself forward by frictional engagement of the ski with the snow through the portion 17, or in making turns and the like while skiing downhill.

The aforementioned tapered space between the vertical portions 42 facilitates the entry of the boot 20 thereinto when the boot 20 is lowered vertically from a position which may in some instances be above the top edges 35 of the restrainer 30. Outwardly curving portions 44 of the vertically extending members 41 and 42 are provided to further facilitate the entry of the boot 20.

Also provided in the second preferred embodiment 30 is a highly compressible resilient body 54 disposed beneath the upwardly curved portion 43 to exclude snow, ice and moisture. Such snow or ice or other foreign material which could otherwise lodge beneath the member 43 could, of course, impede the downward motion of the member 43 as hereinabove described and thus hamper the operation of the heel restrainer 30. The body 54 may comprise a hollow body formed by a closed sheet of flexible, water impervious material, or may comprise foam rubber or the like having its exposed surfaces 47 sealed against the entry of moisture. The body 54 may be bonded to a lower surface 55 of the portion 43, and to the upper surface of the base 64.

Figure 5:
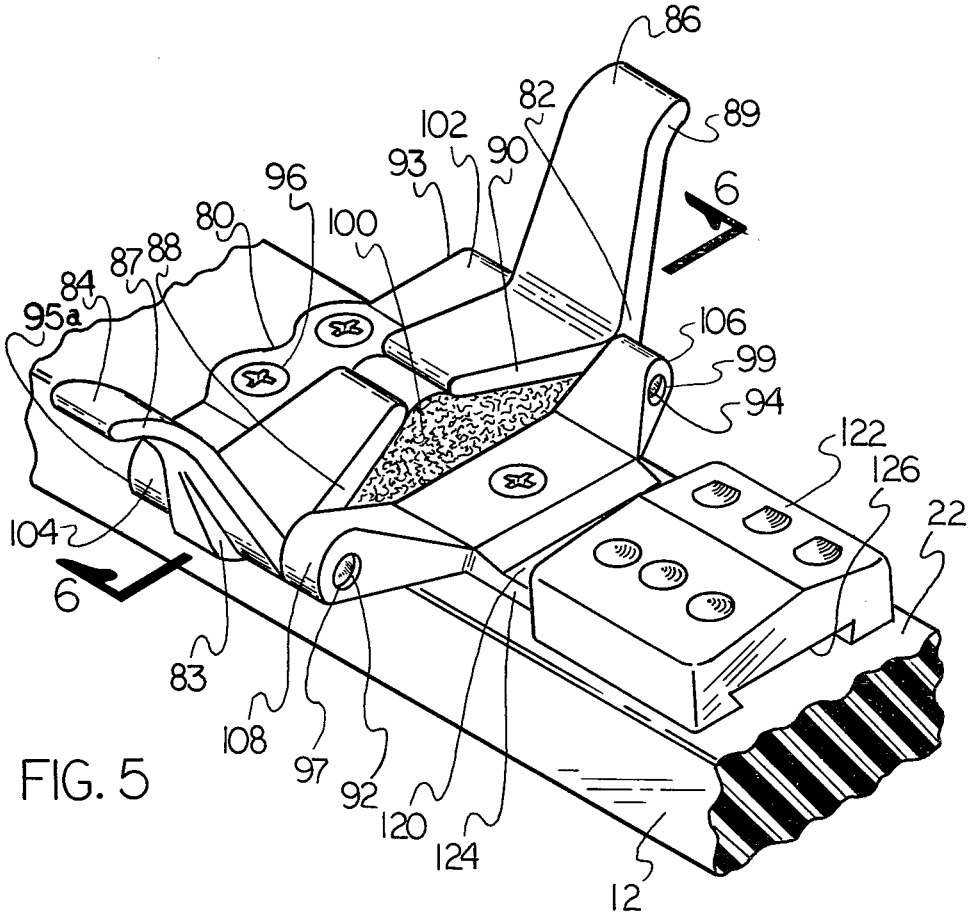
FIG. 5 is an enlarged perspective representation of a second embodiment of the restrainer mounted upon a ski, partially shown.
Figure 6:
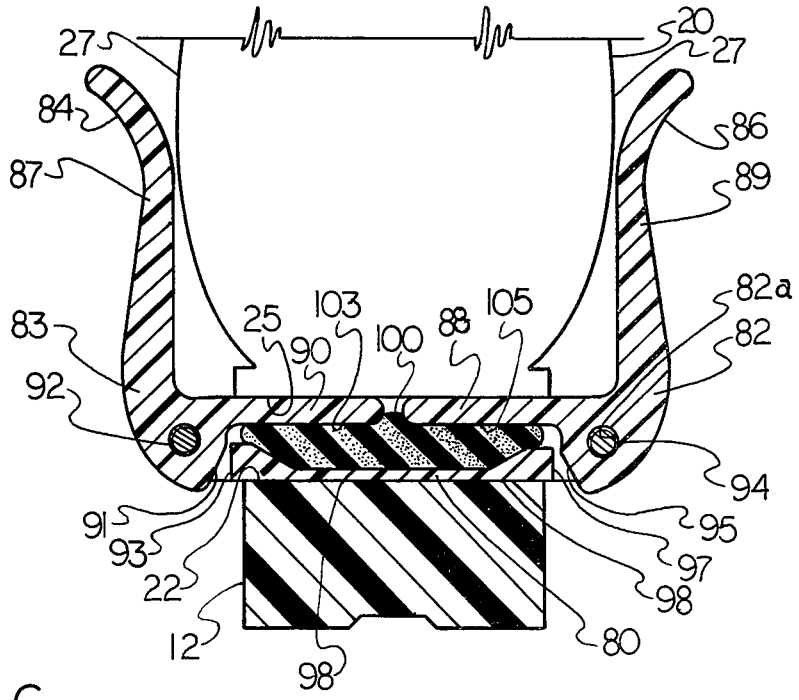
FIG. 6 is a cross-sectional representation of the restrainer of FIG. 5 taken along line 6—6 of FIG. 6, showing also a ski boot disposed therein and being gripped by the restrainer.

Turning now to FIGS. 5 and 6, a second and equally preferred embodiment of the boot restrainer 30 is seen. The restrainer 30 seen in FIGS. 5 and 6 comprises two generally L-shaped, essentially rigid members 82 and 83 carrying spaced apart upwardly extending portions 87 and 89 respectively (See FIG. 6). The member 82 carries a bore 82a (FIG. 6) and a pin 94 therein. A base 80 is provided, being secured to the upper face 22 of the ski 12 by screws 96 extending through bores, not shown, through the base 80 into bores, not shown, extending into the ski 12. As best seen in FIG. 6, the base 80 has an essentially flat surface 98 which mates with the upper surface 22 of the ski 12. Best seen in FIG. 6, member 83 carries a stopping surface 91 which engages a mating surface 93 carried by the base 80, so that outward bias of the member 83 is limited. Similar surfaces 95 and 97 are carried by member 82 and base 80 respectively.

Knobs or bosses 104 and 108 carried by the base 80 carry axially aligned bores 95a and 97 accepting the pin 92 at opposite ends thereof. Similarly, the projections 102 and 106 carry axially aligned bores 93 and 99 accepting opposite ends of the pin 94. Accordingly, the L-shaped members 82 and 83 communicate pivotally with the base 80 through the pins 92 and 94 respectively.

The stopping surfaces 91 and 95 of the L-shaped members 82 and 83 are biased rotatably against surfaces 93 and 97 provided on the base 80. The aforesaid biasing of the L-shaped members 82 and 83 is achieved by the action of a resilient compressible body 100 installed beneath generally horizontal portions 88 and 90 of the L-shaped members 82 and 83. The body 100 may be of foam rubber or other highly compressible resilient material and may be bonded to under surfaces 105 and 103 of the L-shaped members 82 and 83 respectively. The body 100 may be inherently water impermiable or may be of water absorbant material having all exposed surfaces treated or sealed to prevent the entry of water. Subsequent freezing of absorbed moisture to hamper the rotating action of the L-shaped members is prevented thereby.

The biasing action of the resilient body 100 could be acheived also by the use of compression springs or resilient cantilevered spring members positioned between the lower surfaces 103 and 105 and the upper surface of the base 80 without departing from the essential spirit of the invention.

The boot restrainer baseplate 80 carries a rearwardly extending portion 120 upon which may be mounted a heel plate 122. It is desireable that the heel plate 122 be selectively locatable with respect to the L-shaped members 82 and 83 so that ski boots 20 of varying sizes, shapes and lengths may be accomodated. It is noted at this point that ski boots of varying sizes may be satisfactorily restrained by the restrainer 30 in a fixed location upon the ski 12 since the boot need not be restrained in any precise location so long as it is restrained generally near the central instep portion 19 of the boot. (FIG. 2) However, it is desireable that the heel plate 22 be located beneath the heel 21 of the boot 20, and that it be of such a thickness as to support the heel of the boot when the boot is depressing and being gripped by the restrainer 30.

Accordingly, the extension 120 of the base 80 may be provided with inwardly and downwardly tapering sides 124 mating with a similarly shaped recess 126 provided in the bottom portion of the heel plate 122 (See FIG. 5). The recess 126 extends the full length of the heel plate 122. Not shown in FIG. 5 are one or more cylindrical projections extending from the body of the heel plate 122 downwardly, and a series of mating bores in the extension 120 to accept the downward extensions from the heel plate 122. The mating recesses in the extension 120 are longitudinally spaced with respect to the ski 12 so that the heel plate 122 may be selectively positioned on the extension 120 and held in selectable position by the projections from the heel plate extending into the recesses provided in extension 120. The heel plate 122 is of elastic material so that it may be snapped into its selected position. Any other suitable securing method may be used without departure from the spirit of the invention.

The heel plate 122 may be selected to be of appropriate thickness to support the heel 21 while the boat 20 is being gripped by the restrainer 30, as may be required by individual boot designs. It should be understood that the heel plate could be provided as a separate part unconnected with the gripping portions of the restrainer 30, inwhich case it would be independently secured to the surface 22 of the ski 12.

The central or instep portion, 19 (See FIGS. 1 and 2) of the boot 20 lifts a lesser distance from the surface 22 of the ski 12 than, for example, does the heel portion 21. Therefore, the upstanding members 82 and 83 may be shorter and extend a lesser vertical distance than would be possible were the boot restrainer 30 located at the heel of the boot 20. This is because the instep 19 of the boot 20 requires guidance through a lesser vertical distance when the boot is being inserted into the restrainer 30 than does the heel 21. Shorter upstanding vertical members 82 and 83 need extend outwardly from the ski in their biased position no further than does the toe binding 14, so that virtually no additional interference between the skis occurs from the use of the restrainer 30. Also, the likelihood of interference between restrainers of two skis during use of the ski is further reduced because of the natural indentation of the instep of the boot into which the corresponding upstanding members 82 or 83 tends to conform to when the boot 20 is in its downward gripped position. Location of the restrainer apparatus 30 near the center or instep portion of the boot 20 is therefore very advantageous to the practical application of the restrainer 30.

The manner in which the second preferred embodiment of the heel restrainer 30 operates to aid the skier is now described, with reference to FIG. 6. In FIG. 6, cross country ski boot 20 is shown placed downwardly into the space formed between the vertical portions 87 and 89 of the L-shaped members 82 and 83. The weight of the skier has acted through bottom 25 of the boot 20 downwardly upon upper surfaces carried by the horizontal portions 88 and 90 of the L-shaped members 82 and 83. The weight of the skier acting through his boot 20 has compressed the body 100 so that the outwardly directed biases of the members 82 and 83 have been overcome and the vertical portions 87 and 89 of the L-shaped members 82 and 83 made to grip the sides 27 of the boot 20, holding the boot firmly in a central position with respect to the ski 12.

With reference to FIG. 6, it is apparent that the skier may lift the boot 20 from the ski 12 without such movement being in any way impeded, the boot lifting freely as the L-shaped members 82 and 83 are biased away from each other by the resiliency of the body 100 acting upon the under surfaces 103 and 105 of the horizontal portions 88 and 90.

Note also that the members 82 and 83 when in their fully biased positions against stops 93 and 97 form an upwardly increasing tapering opening therebetween, so that a downwardly placed boot 20 is guided into a position central to the restraint 30 and the ski 12. Outwardly curving portions 84 and 86 of the members 82 and 83 respectively further aid the placement of the boot 20 accurately down into the restrainer 30.

It is evident that, as with the previously described embodiment, the restraint 30, by firmly holding the boot 20 in a central position upon the ski 12, aids in the use of the ski in propelling the skier along the snow or in his control of the ski when in downhill motion.

With either illustrated embodiment, the restrainer 30 could be designed and located to grip the boot 20 at any location rearward of the toe 23, and would provide restraint against the unwanted horizontal rotation of the boot 20. However, it is most advantageous that the restrainer 30 grip the boot in its approximate instep location.

It should be understood that the embodiments of the invention described herein are for illustrative purposes only and that the scope and breadth of the present invention are intended to be defined only by the appended claims, and that any embodiment of the present invention defined by the boundaries of the claims are intended to be embraced therein. All embodiments within the meaning and range of equivalency of the appended claims are intended to be embraced therein. The invention may be embodied in other specific forms than those illustrated without departing from the spirit or essential characteristics thereof.

What is claimed and desired to be protected by United States Letters Patent is:

1. In combination with a ski assembly which comprises:

an elongated ski having an upper surface and a snow engaging lower surface and a forward portion and a rearward portion, and a suitable binding apparaus carried by the forward portion for securing a toe of a ski boot to the upper surface of the ski, the improvement comprising:

a base plate secured to the upper surface of the ski by any suitable means.

at least one pair of substantially rigid members so disposed as to extend generally vertically from the base plate and spaced apart from each other so as to define a space therebetween to accept the boot at its central instep region, means securing the pair of members to the base plate, said means permitting at least one member of the pair to pivot laterally in respect to the ski, so that the space between the members is changed in extent as said member is caused to pivot, a generally horizontal member carried by each pivoted vertical member and extending above and generally parallel to the base plate and toward the center of the ski, means biasing the pivoted member generally away from the ski, so that the space between the members of the pair is enlarged so as to permit unimpeded downward insertion of the boot into the space, the biasing means being such as to be thereafter overcome by the weight of a skier acting downwardly through the boot, so that the enlarged space is decreased when the boot is lowered into the space to the vicinity of the base plate and the boot is gripped between the vertical members, and lateral movement thereof is thus prevented, and so that the boot is released when it is subsequently raised from the vicinity of the base plate, and heel plate means carried by the ski, said means carrying the heel of the boot when the boot is downwardly disposed and gripped in its central instep portion.

2. The improvement of claim 1, wherein the biasing means comprises:

a pad of suitable thickness of resilient material disposed between the base plate and the horizontal portion of the vertical member, and the heel plate means is carried by an integral portion of the base plate extending rearwardly along the upper surface of the ski.

3. The improvement of claim 1 wherein:

the heel plate means is carried by an integral portion of the base plate extending rearwardly along the upper surface of the ski.

4. The improvement of claim 1 wherein the biasing means comprises:

at least one compression spring disposed between the horizontal member and the base plate, so as to bias the pivoting vertical member outwardly from the center of the ski, and a sheath of suitable resilient material suitable adhered to the horizontal member and the base plate, so as to exclude moisture, snow and ice from entering between the horizontal portion and the base plate so that the pivoting of the member is not impeded during use of the ski.

5. A ski boot restraining apparatus for a cross-country ski having an upper surface and a lower snow engaging surface, comprising:

a base plate adapted to be secured to the upper surface of the ski by any suitable means.

at least one pair of substantially rigid members so disposed as to extend generally vertically from the base plate and spaced apart from each other so as to define a space therebetween to accept the boot at its central instep region, means securing the pair of members to the base plate, said means permitting at least one member of the pair to pivot laterally with respect to the ski, so that the space between the members is changed in extent as said member is caused to pivot, a generally horizontal member carried by each pivoted vertical member and extending above and generally parallel to the base plate and toward the center of the ski, means biasing the pivoted member generally away from the ski, so that the space between the members of the pair is enlarged so as to permit unimpeded downward insertion of the boot into the space, the biasing means being such as to be thereafter overcome by the weight of a skier acting downwardly through the boot, so that the enlarged space is decreased when the boot is lowered into the space to the vicinity of the base plate and the boot is gripped between the vertical members, and lateral movement thereof is thus prevented, and so that the boot is released when it is subsequently raised from the vicinity of the base plate, and heel plate means carried by the ski, said means carrying the heel of the boot when the boot is downwardly disposed and gripped in its central instep portion.

6. The improvement of claim 5, wherein the biasing means comprises:

a pad of resilient material of suitable thickness disposed between the base plate and the horizontal portion of the vertical member, and the heel plate means is carried by an integral portion of the base plate extending rearwardly along the upper surface of the ski.

7. The improvement of claim 5 wherein:

the heel plate means is carried by an integral portion of the base plate extending rearwardly along the upper surface of the ski.

* * * * *